United States Patent [19]

Mori et al.

[11] Patent Number: 4,671,897

[45] Date of Patent: Jun. 9, 1987

[54] PROCESS AND APPARATUS FOR SOLIDIFICATION OF RADIOACTIVE WASTE

[75] Inventors: Kazuhide Mori; Shin Tamata; Makoto Kikuchi, all of Hitachi, Japan

[73] Assignee: Hitachi, Ltd., Tokyo, Japan

[21] Appl. No.: 697,384

[22] Filed: Feb. 1, 1985

[30] Foreign Application Priority Data

Feb. 9, 1984 [JP] Japan ..... 59-22433

[51] Int. Cl.[4] ..... G21F 9/16

[52] U.S. Cl. ..... 252/628; 252/626; 252/631; 264/0.5; 423/11

[58] Field of Search ..... 252/628, 631, 636, 626, 252/627; 210/682, 912; 423/11, 12; 264/0.5; 106/74, 76, 85, 89

[56] References Cited

U.S. PATENT DOCUMENTS

| | | | |
|---|---|---|---|
| 1,059,531 | 4/1913 | Ebler | 210/682 |
| 3,720,609 | 3/1973 | Smith et al. | 210/751 |
| 3,962,080 | 6/1976 | Dulin et al. | 210/751 |
| 4,086,325 | 4/1978 | Cordier | 423/280 |
| 4,124,405 | 11/1978 | Quiénot | 210/751 |
| 4,401,591 | 8/1983 | Korostenski | 252/629 |
| 4,459,212 | 7/1984 | Carini | 252/628 |
| 4,511,541 | 4/1985 | Bierman et al. | 210/751 |
| 4,530,723 | 7/1985 | Smeltzer | 252/628 |

FOREIGN PATENT DOCUMENTS

| | | | |
|---|---|---|---|
| 0757712 | 4/1971 | Belgium | 252/635 |
| 2284956 | 5/1976 | France | 252/635 |
| 2333331 | 6/1977 | France . | |
| 2356246 | 1/1978 | France . | |
| 9008699 | 1/1974 | Japan | 252/628 |
| 60-14195 | 2/1981 | Japan | 252/628 |
| 1575300 | 9/1980 | United Kingdom | 252/635 |

OTHER PUBLICATIONS

Hawley, 1981, The Condensed Chemical Dictionary, 10th edition, Van Nostrand Reinhold Company, New York, p. 427.

*Primary Examiner*—Stephen J. Lechert, Jr.
*Assistant Examiner*—Howard J. Locker
*Attorney, Agent, or Firm*—Fay, Sharpe, Beall, Fagan, Minnich & McKee

[57] ABSTRACT

Radioactive waste is first converted into hardly water-soluble powder (including a water-insoluble powder) and then solidified with a hydraulic solidifier in a solidification vessel. The radioactive waste may be powdered (including granulated and encapsulated) by incorporating the radioactive waste with a substance which is capable of reacting with the water-soluble salt contained in the radioactive waste to form a hardly water-soluble salt (including a water-insoluble salt) and then powdering the mixture with drying, or by powdering the radioactive waste with drying, granulating the powder with drying and then microencapsulating the granules with a hardly water-soluble substance (including water-insoluble substance). The hardly water-soluble salts are preferably calcium salts, and the additives are preferably calcium hydroxide solution or solvent of combination of dichloromethane solution and hexane.

9 Claims, 5 Drawing Figures

PROCESS AND APPARATUS FOR SOLIDIFICATION OF RADIOACTIVE WASTE

BACKGROUND OF THE INVENTION

This invention relates to a process and apparatus for solidification of radioactive waste occurring in a nuclear power station, and more particularly to a process and apparatus for its solidification utilizing a hydraulic solidifier.

The amounts of radioactive waste occurring in nuclear power stations and related facilities have been increasing year by year, and a need for the volume reduction of such radioactive waste has consequently been increasing in order to secure a storage space within the facilities.

Methods which have so far been examined for the volume reduction of radioactive waste includes the following. Concentrated liquid waste obtained by concentrating the liquid waste formed in the regeneration of spent ion-exchange resin and the slurry of powdery ion-exchange resin which occur in large amounts in a nuclear power station are dried into powder. Thus the liquid waste is freed of water which accounts for the major or part of its volume and, if necessary, the powder is further pelletized and solidified collectively by packing in a solidification vessel. (U.S. Pat. No. 4,299,271).

However, such a method is still defective in that the liquid waste cannot necessarily be converted into a stable solid when using a hydraulic solidifier such as cement or alkali silicates (e.g. water glass).

The concentrated liquid waste occurring in a boiling water reactor (BWR) nuclear power station is composed chiefly of a sodium salt, i.e. sodium sulfate ($Na_2SO_4$). In a pressurized water reactor (PWR) nuclear power station, on the other hand, the concentrated liquid waste is composed chiefly of a sodium salt, i.e. sodium borate ($Na_2B_4O_7$). These sodium salts are both water-soluble.

In case the concentrated liquid waste occurring in a BWR nuclear power station is dried, powdered or, if necessary, further pelletized, and then solidified with a hydraulic solidifier, sodium sulfate which is its main ingredient will absorb free water contained in the solidifier paste and water formed by the solidification reaction, and thereby form a swollen hydrate, $Na_2SO_4.10H_2O$, to cause cracking in the solidified body. In addition, in case of a cement solidifier, sodium sulfate will react with calcium hydroxide which is formed when cement is hydrated, and thereby form gypsum, which will prevent the cement from hardening too rapidly but will, on the other hand, accelerate the formation of ettringite ($3CaO.Al_2O_3.3CaSO_4.32H_2O$) to cause the solidified body to be swollen or broken.

In case the concentrated liquid waste occurring in a PWR nuclear power station is solidified, sodium borate, which is the main ingredient, will likewise cause the solidified body to lower its strength. It will form a hydrage, $Na_2B_4O_7.10H_2O$, to generate heat. In the case of a cement solidifier, it will inhibit the formation of a hydrate of calcium silicate ($3CaO.2SiO_2.3H_2O$) and of a hydrate of calcium aluminate ($3CaO.Al_2O_3.6H_2O$) by the hydration of cement.

Since, in either of these cases, the powdered or pelletized waste mainly comprises the water-soluble sodium salts, the solidified body suffers from degradation of its structure, reduction in the leaching rate, and lowering in the strength and specific gravity owing to exudation during a prolonged storage.

In the solidification procedure, furthermore, sodium borate reacts with the hydraulic solidifier very promptly, and the solidification proceeds so rapidly as to disturb the smooth pouring of the solidification mixture. To prevent this, the content of the liquid waste in the solidification mixture will have to be limited to at most 30 wt % and the volume reduction ratio be correspondingly lowered.

SUMMARY OF THE INVENTION

The object of the present invention is to provide a process for the solidification of radioactive waste wherein the solidified body is obtained having high consistency for a long time.

Another object of the present invention is to provide a process for the solidification of radioactive waste wherein the solidified body is obtained having high volume reduction.

Another object of the present invention is to provide a process for the solidification of radioactive waste wherein the solidified body is obtained having less degradation of its structure owing to exudation.

Another object of the present invention is to provide a process for the solidification of radioactive waste wherein the solidified body is obtained having low leaching rate.

The inventors have drawn their attention to the finding that the above-mentioned problems are all due to the soluble salt contained as the main ingredient in the liquid waste. Thus, they have made various studies in the belief that these problems could be solved by converting the radioactive waste into a hardly water-insoluble salt structure (including an insoluble structure) before it is submitted to a solidification process, and have finally attained the present invention.

The process for solidification of radioactive waste according to this invention is characterized in that the radioactive waste is first converted into a hardly water-soluble powder (including a water-insoluble powder) and then solidified with a hydraulic solidifier in a solidification vessel.

The radioactive waste may be powdered (including granulated and encapsulated) by incorporating the radioactive waste with a substance which is capable of reacting with the water-soluble salt contained in said radioactive waste to form a hardly water-soluble salt (including a water-insoluble salt) and then powdering the mixture with drying, or by powdering the radioactive waste with drying, granulating the powder with drying and then microencapsulating the granules with a hardly water-soluble substance (including water-insoluble substance).

$Na_2SO_4$ and $Na_2B_4O_7$ which are main ingredients of liquid radioactive waste occurring in a nuclear power station have high solubilities in water.

In order to see how $Na_2SO_4$ could be converted into salts hardly soluble (including insoluble) in water and what type of salts they should be, and with attention drawn to the fact that alkaline earth metal sulfates and metal chelate salts were hardly soluble in water, in general, the present inventors selected calcium sulfate, strontium sulfate and barium sulfate for the former, and ammonium cobalt oxalate sulfate and hexaammonium chromium sulfate for the latter to examine their solubilities. The results are shown in Table 1. This table shows the values observed at 20° C.

TABLE 1

| Substance | Solubility (wt %) | Substance | Solubility (wt %) |
|---|---|---|---|
| sodium sulfate | 16.0 | ammonium cobalt oxalate sulfate | 0.8 |
| calcium sulfate | 0.205 | | |
| strontium sulfate | $1.3 \times 10^{-2}$ | hexaammonium chromium sulfate | 2.7 |
| barium sulfate | $2 \times 10^{-4}$ | | |

It was found that all these substances had lower solubilities than sodium sulfate and that conversion into barium sulfate was more effective than into the rest for the intended purpose. In respect of cost, however, conversion into calcium sulfate was thought to be most economical and most practical. Various borates were also tested for solubilities, and conversion into calcium borate was likewise found to be appropriate in respect of cost and practical application.

The radioactive waste materials which can be solidified by the procedures include not only dried granulates of concentrated liquid waste and sludge consisting of sodium sulfate, sodium borate, etc. but also a slurry waste of ion-exchange resin, and the so-called miscellaneous solid matters, such as HEPA filters, vinyl sheet clothings and wooden pieces, and their fragments.

The solidifer includes not only an alkali silicate composition but also fluid solidifier, such as a thermosetting or thermo-fusible plastic, asphalt, mortar or cement.

According to this invention providing a process and apparatus in which the dry powder obtained from the radio-active waste occurring in a nuclear power station is solidified with a hydraulic solidifier, the solidified body can not only be extensively protected from its deterioration and damage caused by water absorption, hydration, exothermic reaction, swelling and leaching due to the sodium sulfate and sodium borate contained in the radioactive waste to thereby retain its consistency for a long time, but also be improved outstandingly in volume reduction ratio.

DETAILED DESCRIPTION OF THE PREFERRED EMBODIMENTS

EXAMPLE 1

Figure 1:
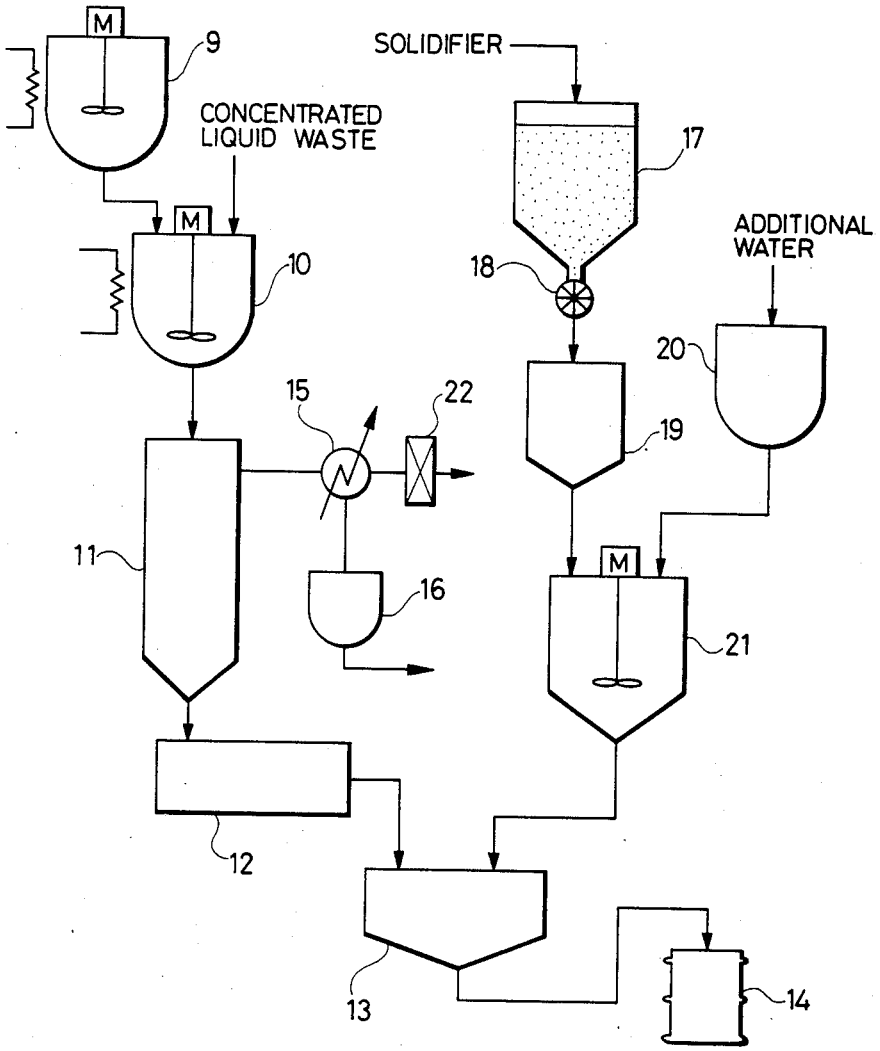
FIG. 1 is the outline of the solidification system in an example 1 of this invention.

A simulated liquid waste for the concentrated liquid waste occurring in a pressurized water reactor (PWR) nuclear power station was incorporated with an additive in a given amount, and the mixture was dried into powder and solidified with a hydraulic solidifier.

The simulated liquid waste had the same composition as the real liquid waste, and an aqueous solution of $Na_2B_4O_7$ was prepared by dissolving $H_3BO_3$ with NaOH. The simulated liquid waste contained 10 $\mu$Ci of $^{137}Cs$ (typical nuclide of nuclear fission products).

In an additive tank 9 was placed an aqueous calcium hydroxide solution (0.1 wt %) as the additive, which was maintained at 40° C. by a heater and stirred continuously. Then, a given amount (50 kg/batch) of the simulated liquid waste was introduced into an adjusting and weighing tank 10. The aqueous calcium hydroxide solution was subsequently transferred from the additive tank 9 to the adjusting and weighing tank 10 in such an amount that its calcium content be in equivalent moles to the boric acid present in the simulated liquid waste, and the liquid mixture in the tank was stirred at 40° C. for about one hour.

As a result, the sodium borate in the liquid waste reacted with the calcium hydroxide solution to give a hardly water-soluble salt (calcium borate). Subsequently, the simulated liquid waste was introduced into an evaporator 11 and dried into powder. The steam generated by the evaporator 11 was condensed by a condenser 15 and recovered as condensed water, which was stored in a condensed water tank 16 and treated later in a separate system. The exhaust gas passing through the condenser 15 was discharged in the air via a filter 22.

The dry powder formed in the evaporator 11 was transferred to a drier 12 provided between the evaporator 11 and a mixer 13, so that the powder is prevented from absorbing water and increasing its water content in the course of its being introduced into the mixer 13. The drier 12 had such a structure that the dry powder could be stored therein for feed to the mixer 13 in a certain rate.

Meanwhile, a powdery solidifier (an alkali silicate composition) was introduced into a solidifier tank 17, where it was stored temporarily, and then introduced into a solidifier weighing tank 19 via a rotary feeder 18. The tank 19 was provided with a load cell for controlling the amount of the solidifier introduced.

Additional water for solidification was introduced from a water feed system into an additional water weighing tank 20 and weighed. The solidifier comprising the alkali silicate composition and the additional water, after being weighed, were introduced into a solidifier kneading tank 21, where they were kneaded, and then introduced into the mixer 13 containing the dry powder of the simulated radioactive waste. In the mixer 13, the dry powder and the alkali silicate composition in amounts adjusted to 50 wt % each were kneaded and then introduced into a 200-l vessel 14 for solidification.

The solidified body obtained in this Example 1 was cut, so that its inside structure was observed. As a result, it was confirmed to be a consistent solid body, with no pores occurring due to the exudation of sodium borate. In the course of the solidification procedure, any exothermic reaction such as the conventional one occurring in the solidification with powdery sodium borate did not occur, either. Since the solidification with powdery sodium borate in prior art had been attended by an exothermic reaction as described above, its content in the solidified product had been limited to at most 30 wt %, and the volume reduction ratio had accordingly been low. In contrast, the present process made it possible to add the solidifier up to at least 50 wt % to thereby raise the volume reduction ratio outstandingly.

Figure 2:
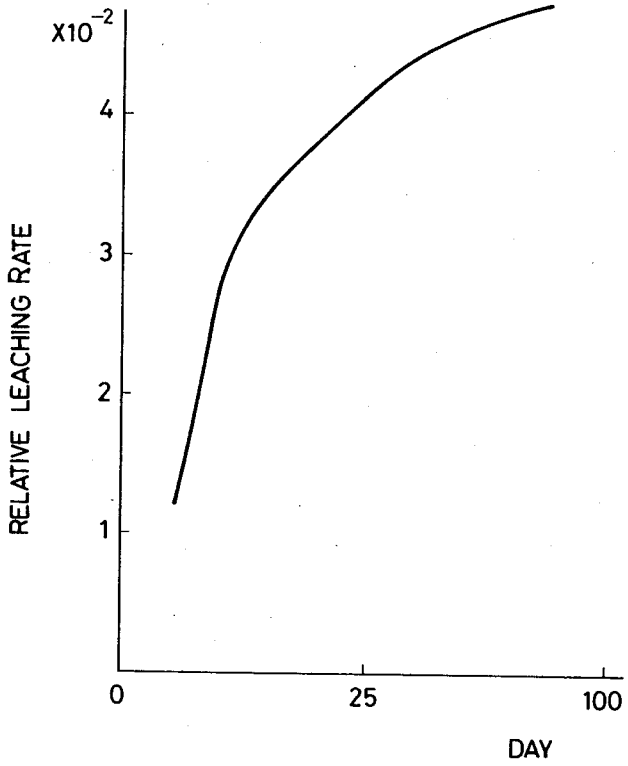
FIGS. 2 and 3, respectively, are diagrams showing changes in relative leaching rate and relative crushing strength with time observed on the solidified body prepared in said example 1.
Figure 3:
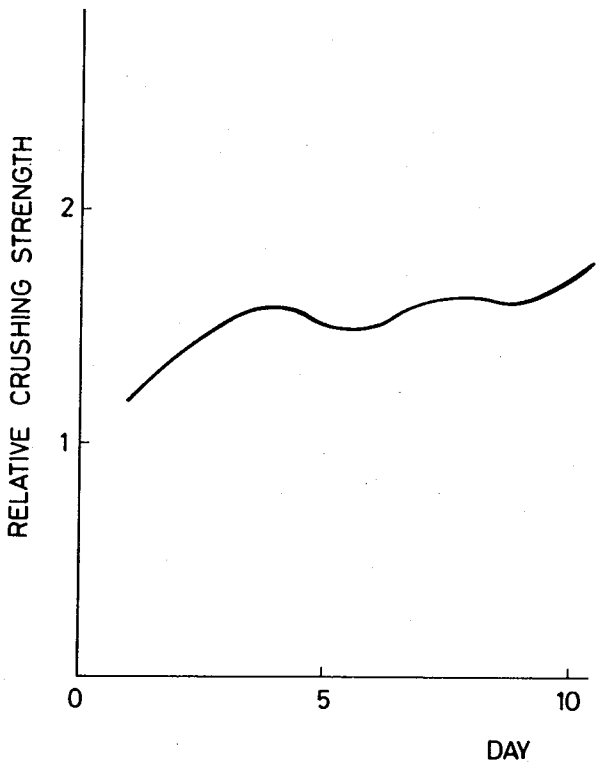

The solidified product prepared in this Example 1 was further observed for changes in its leaching characteristics and crushing strength with time, and the values obtained thereby were found to be satisfactory. FIG. 2 is a diagram showing changes in relative leaching rate with time, and FIG. 3 showing changes in relative crushing strength with time. The figures shown are relative values assuming the value observed on a solidified body prepared by a process using intact sodium borate to be 1.

It was confirmed from these figures that the leaching characteristics were improved on the order of $10^2$ and the crushing strength increased 1- to 1.5-fold when the solidification treatment in this Example 1 was conducted after sodium borate was converted into calcium borate.

EXAMPLE 2

In the preceding Example 1, the simulated liquid waste incorporated with calcium hydroxide was powdered and the powder was directly solidified. In the present Example 2, however, the powder was solidified after it was further granulated by a granulator, whereby a consistent solid product with good leaching characteristics was likewise obtained.

Figure 4:
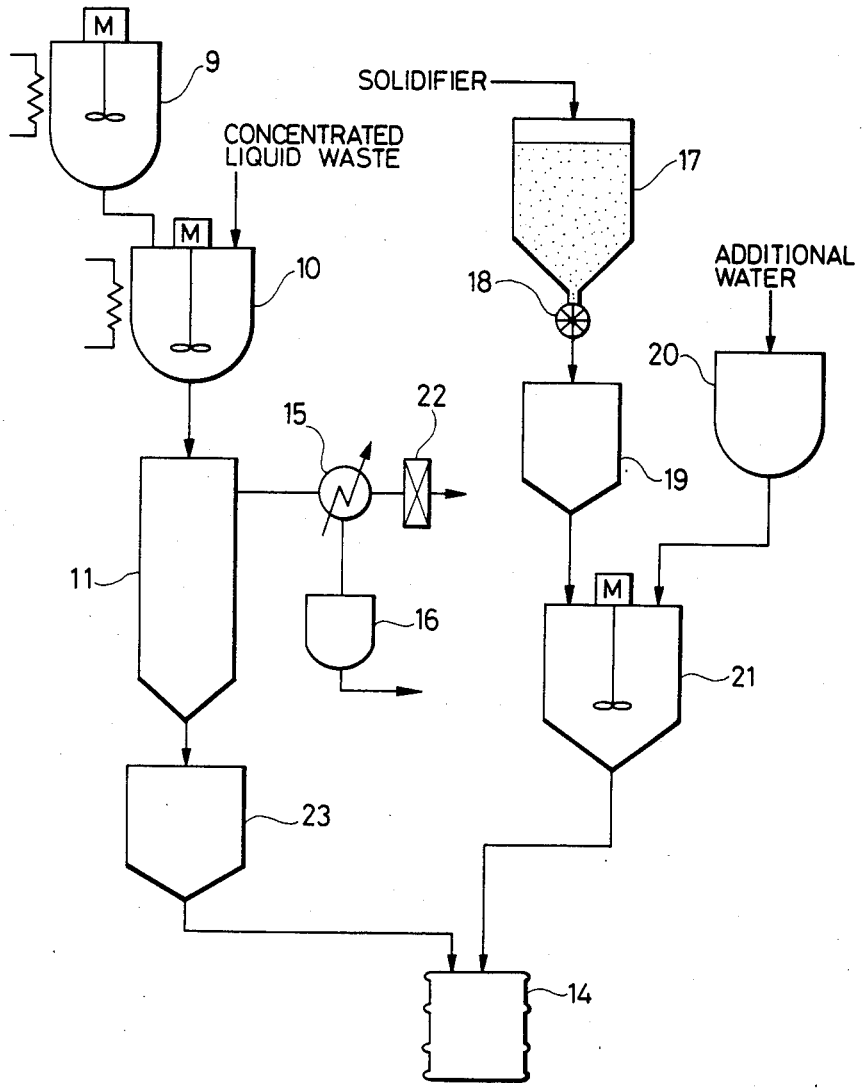
FIGS. 4 and 5 are the outlines of the solidification systems in other examples of this invention.

The solidification procedures employed herein are shown in FIG. 4. The concentrated liquid waste occurring in a pressurized water reactor was subjected to the same process of adding calcium hydroxide as in Example 1 and then dried into powder, which was then pelletized by a granulator 23, and about 160 kg of the pellets were packed in the 200-l vessel 14. Subsequently, 160 kg of a solidifier comprising an alkali silicate composition kneaded with water was poured from above into the vessel to effect the solidification. The solidified body prepared in this Example 2 had the same characteristics and effects as the one prepared in Example 1.

EXAMPLE 3

The Example 3 used a simulated liquid waste for a concentrated liquid waste consisting chiefly of $Na_2SO_4$ occurring in a boiling water reactor, unlike Example 1 and Example 2 for a concentrated liquid waste occurring in a pressurized water reactor. In Example 3, the same procedures as in Example 1 were employed, except that the simulated liquid waste was composed of $Na_2SO_4$. It was confirmed that the solidified product prepared in Example 3 had the same characteristics and effects as in Example 1. In this Example 3, the powder was solidified directly.

EXAMPLE 4

In Example 4, a powder was solidified after it was pelletized as in Example 2. It was confirmed that the solidified product prepared in the Example 4 had same characteristics and effects as in Example 2.

EXAMPLE 5

Figure 5:
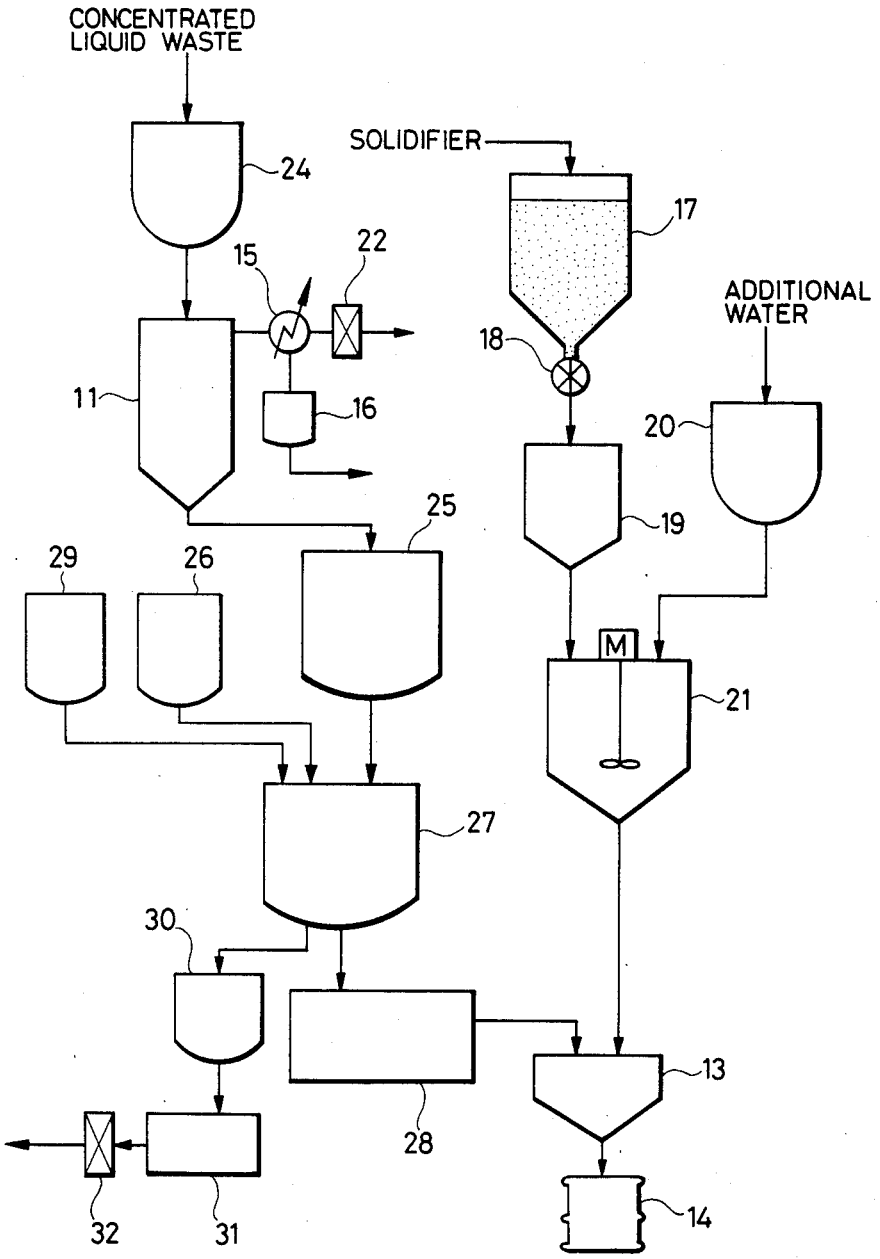

In the Example 5, as shown in FIG. 5, a concentrated liquid waste occurring in a pressurized water reactor was powdered and granulated, and the granules were micro-encapsulated with a water-insoluble coating and then solidified.

A simulated liquid waste used herein had the same composition as in Example 1. The simulated liquid waste was transferred to a storage tank 24, and a given amount (50 kg/batch) of it was transferred from the tank 24 to an evaporator 11, where it was dried into powder. The exhaust gas generated in this case was treated in the same manner as in Example 1. The powder was subsequently shaped into granules, about 0.5 mm in size, by a granulator 25 and then introduced into a reaction tank 27. Separately, a dichloromethane solution of ethylcellulose (9 wt %) and n-hexane as microencapsulation solvents were placed in additive tanks 26 and 29, respectively.

In the first step, about 200l of the ethylcellulose solution was introduced into the reaction tank 27 containing the granulated radioactive waste, and the mixture was stirred at 25° C. for 5 minutes to disperse the granules. In the second step, 500l of n-hexane was introduced into the same reaction tank 27, and the mixture was stirred at 25° C. for about one hour. Subsequently, the mixture was cooled rapidly to 4° C. and allowed to stand for 24 hours, after which the supernatant was removed and the capsules formed were separated. In the third step, the capsules were cleaned, and their wall membrane hardened, by 1 $m^3$ of cold n-hexane, and then transferred into a vacuum drier 28. The organic solvent occurring in this step was stored temporarily in a storage tank 30 and then disposed by burning with a burner 31, while the exhaust gas was passed through a filter 32 and discharged in the air.

Subsequently, the capsules were dried completely in the vacuum drier 28 maintained at a temperature of about 60° C., and a given amount (about 160 kg) of the dried capsules were introduced into a mixer 13. A solidifier feed system was arranged in the same manner as in Example 1. About 160 kg of a paste of an alkali silicate composition with water was introduced into the mixer 13 and kneaded with the capsules therein, and the mixture was poured into a 200-l vessel 14 to effect the solidification.

The solidified body prepared in this example exhibited the same leaching characteristics and crushing strength as the one prepared in Example 1.

EXAMPLE 6

In the Example 6, $Na_2SO_4$ solution simulating a concentrated liquid waste occurring in a boiling water reactor was used. It was confirmed that the solidified product prepared in the Example 6 had the same time characteristics and effects as in Example 5.

What is claimed is:

1. In a process for solidification of radioactive waste comprising the steps of:

drying a water-soluble salts containing radioactive waste;

shaping said dried radioactive waste into granules;

microencapsulating said granules into water insoluble salts containing radioactive waste in microencapsulation solvents; and solidifying said microencapsulated radioactive waste with a hydraulic solidifier in a solidification vessel;

the improvement comprising:

said step of microencapsulating employing said microencapsulation solvents that are a dichloromethane solution and a hexane;

said microencapsulating step including a first step of mixing the granules with the dichloromethane solution, thereafter the second step of cooling the mixture and removing supernatant and separating the capsules formed, and the third step of hardening the wall membrane of the capsules by adding cold hexane and thereafter drying the capsules.

2. A process for solidification of radioactive waste according to claim 1, wherein said dichloromethane solution is an ethylcellulose solution, and said hexane is n-hexane.

3. A process for solidification of radioactive waste according to claim 2, wherein said ethylcellulose solution is about 9% weight.

4. A process for solidification of radioactive waste according to claim 2, wherein said step of solidifying adds the solidifier up to about 50 WT %.

5. In a process for solidification of radioactive waste comprising the steps of:

drying a water-soluble salts containing radioactive waste;

shaping said dried radioactive waste into granules;

microencapsulating said granules into water insoluble salts containing radioactive waste in microencapsulation solvents; and solidifying said microencapsulated radioactive waste with a hydraulic solidifier in a solidification vessel;

the improvement comprising;

said step of microencapsulating employing said microencapsulation solvents that are a dichloromethane solution and a hexane.

6. A process for solidification of radioactive waste according to claim 5, wherein said dichloromethane solution is an ethylcellulose solution, and said hexane is n-hexane.

7. A process for solidification of radioactive waste according to claim 6, wherein said ethylcellulose solution is about 9% weight.

8. A process for solidification of radioactive waste according to claim 6, wherein said step of solidifying adds the solidifier up to about 50 WT %.

9. A process for solidification of radioactive waste according to claim 5, wherein said step of solidifying adds the solidifier up to about 50 WT %.

* * * * *